US007369104B2

(12) United States Patent
Sakata et al.

(10) Patent No.: US 7,369,104 B2
(45) Date of Patent: May 6, 2008

(54) DRIVING APPARATUS OF DISPLAY PANEL

(75) Inventors: Kazuaki Sakata, Yamanashi-ken (JP); Yoshichika Sato, Yamanashi-ken (JP); Tsutomu Tokunaga, Yamanashi-ken (JP); Hideki Tanaka, Yamanashi-ken (JP); Hideto Nakamura, Yamanashi-ken (JP)

(73) Assignee: Pioneer Corporation, Tokyo (JP)

( * ) Notice: Subject to any disclaimer, the term of this patent is extended or adjusted under 35 U.S.C. 154(b) by 399 days.

(21) Appl. No.: 10/893,232

(22) Filed: Jul. 19, 2004

(65) Prior Publication Data

US 2005/0017962 A1 Jan. 27, 2005

(30) Foreign Application Priority Data

Jul. 22, 2003 (JP) ..... 2003-199660

(51) Int. Cl.
*G09G 3/28* (2006.01)

(52) U.S. Cl. ..... 345/63

(58) Field of Classification Search ..... 345/60–68
See application file for complete search history.

(56) References Cited

U.S. PATENT DOCUMENTS 6,262,699 B1 * 7/2001 Suzuki et al. ..... 345/68
6,294,875 B1 * 9/2001 Kurata et al. ..... 315/169.1
6,486,611 B2 * 11/2002 Tokunaga et al. ..... 315/169.4
6,538,627 B1 * 3/2003 Whang et al. ..... 345/60
6,583,575 B2 * 6/2003 Roh et al. ..... 315/169.1
6,597,334 B1 * 7/2003 Nakamura ..... 345/68
6,630,916 B1 * 10/2003 Shinoda ..... 345/60
6,642,912 B2 * 11/2003 Furutani ..... 345/68
6,888,316 B2 * 5/2005 Seo et al. ..... 315/169.2
6,970,147 B2 * 11/2005 Ishizuka et al. ..... 345/63
7,023,405 B2 * 4/2006 Awamoto et al. ..... 345/60
7,042,423 B2 * 5/2006 Iwami ..... 345/63
7,071,900 B2 * 7/2006 Ide et al. ..... 345/60
2002/0186186 A1 * 12/2002 Hashimoto et al. ..... 345/63

FOREIGN PATENT DOCUMENTS

JP 2000-338932 12/2000

* cited by examiner

*Primary Examiner*—Amr A. Awad
*Assistant Examiner*—Randal Willis
(74) *Attorney, Agent, or Firm*—Drinker Biddle & Reath LLP

(57) ABSTRACT

An apparatus for driving a display panel can execute quality image display. To allow discharge cells operating as pixels of the display panel to repeatedly perform sustain discharge, a fall period of a last sustain pulse of sustain pulses repeatedly applied to row electrodes includes a first voltage drop period in which a voltage value gently drops, a voltage constant period which follows the first voltage drop period and in which the voltage value remains constant for a predetermined period, and a second voltage drop period which follows the voltage constant period and in which the voltage value drops more gently than in the first voltage drop period.

6 Claims, 7 Drawing Sheets

FIG. 2

| PD | DATA CONVERSION TABLE GD 1 | 2 | 3 | 4 | 5 | 6 | 7 | 8 | 9 | 10 | 11 | 12 | 13 | 14 | 1 - FIELD LIGHT EMISSION DRIVING PATTERN SF 1 | SF 2 | SF 3 | SF 4 | SF 5 | SF 6 | SF 7 | SF 8 | SF 9 | SF 10 | SF 11 | SF 12 | SF 13 | SF 14 | LUMINANCE |
|---|---|---|---|---|---|---|---|---|---|---|---|---|---|---|---|---|---|---|---|---|---|---|---|---|---|---|---|---|---|
| 0000 | 1 | 0 | 0 | 0 | 0 | 0 | 0 | 0 | 0 | 0 | 0 | 0 | 0 | 0 | ● | | | | | | | | | | | | | | 0 |
| 0001 | 0 | 1 | 0 | 0 | 0 | 0 | 0 | 0 | 0 | 0 | 0 | 0 | 0 | 0 | ○ | ● | | | | | | | | | | | | | 1 |
| 0010 | 0 | 0 | 1 | 0 | 0 | 0 | 0 | 0 | 0 | 0 | 0 | 0 | 0 | 0 | ○ | ○ | ● | | | | | | | | | | | | 4 |
| 0011 | 0 | 0 | 0 | 1 | 0 | 0 | 0 | 0 | 0 | 0 | 0 | 0 | 0 | 0 | ○ | ○ | ○ | ● | | | | | | | | | | | 9 |
| 0100 | 0 | 0 | 0 | 0 | 1 | 0 | 0 | 0 | 0 | 0 | 0 | 0 | 0 | 0 | ○ | ○ | ○ | ○ | ● | | | | | | | | | | 17 |
| 0101 | 0 | 0 | 0 | 0 | 0 | 1 | 0 | 0 | 0 | 0 | 0 | 0 | 0 | 0 | ○ | ○ | ○ | ○ | ○ | ● | | | | | | | | | 27 |
| 0110 | 0 | 0 | 0 | 0 | 0 | 0 | 1 | 0 | 0 | 0 | 0 | 0 | 0 | 0 | ○ | ○ | ○ | ○ | ○ | ○ | ● | | | | | | | | 40 |
| 0111 | 0 | 0 | 0 | 0 | 0 | 0 | 0 | 1 | 0 | 0 | 0 | 0 | 0 | 0 | ○ | ○ | ○ | ○ | ○ | ○ | ○ | ● | | | | | | | 56 |
| 1000 | 0 | 0 | 0 | 0 | 0 | 0 | 0 | 0 | 1 | 0 | 0 | 0 | 0 | 0 | ○ | ○ | ○ | ○ | ○ | ○ | ○ | ○ | ● | | | | | | 75 |
| 1001 | 0 | 0 | 0 | 0 | 0 | 0 | 0 | 0 | 0 | 1 | 0 | 0 | 0 | 0 | ○ | ○ | ○ | ○ | ○ | ○ | ○ | ○ | ○ | ● | | | | | 97 |
| 1010 | 0 | 0 | 0 | 0 | 0 | 0 | 0 | 0 | 0 | 0 | 1 | 0 | 0 | 0 | ○ | ○ | ○ | ○ | ○ | ○ | ○ | ○ | ○ | ○ | ● | | | | 122 |
| 1011 | 0 | 0 | 0 | 0 | 0 | 0 | 0 | 0 | 0 | 0 | 0 | 1 | 0 | 0 | ○ | ○ | ○ | ○ | ○ | ○ | ○ | ○ | ○ | ○ | ○ | ● | | | 150 |
| 1100 | 0 | 0 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ○ | ○ | ● | | 182 |
| 1101 | 0 | 0 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ○ | ○ | ● | 217 |
| 1110 | 0 | 0 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | ○ | ○ | 255 |

BLACK CIRCLE : SELECTIVE ERASE DISCHARGE
WHITE CIRCLE : LIGHT EMISSION

DRIVING APPARATUS OF DISPLAY PANEL

BACKGROUND OF THE INVENTION

1. Field of the Invention

This invention relates to a driving apparatus of a display panel having capacitive discharge cells.

2. Description of the Related Art

A plasma display apparatus having an AC discharge type plasma display panel mounted thereto as a thin display device is known.

The AC discharge type plasma display panel (hereinafter called "PDP") includes a plurality of column electrodes and a plurality of row electrode pairs so arranged as to respectively intersect the column electrodes while interposing discharge spaces having a discharge gas sealed therein among them. A discharge cell emitting red light, a discharge cell emitting green light or a discharge cell emitting blue light at the time of its discharge is formed at each point of intersection between each row electrode pair and each column electrode inclusive of the discharge space.

Because the discharge cell causes light emission by utilizing the discharge phenomenon, it has only two states, that is, a "light-on state" in which the discharge cell emits light at predetermined luminance, and a "light-off state". In other words, the discharge cells can provide luminance of only two gradations. To achieve luminance display of an intermediate tone corresponding to input image signals by using such discharge cells, a driving apparatus for executing gradation driving in accordance with a sub-field method is disclosed in JP-A-2000-338932.

The sub-field method divides a display period of one field into N sub-fields and allocates in advance periods in which each discharge cell is allowed to continuously emit light (or to be turned off) to each sub-field. Each discharge cell is allowed to emit light or is turned off in accordance with the input image signal for each sub-field for the period allocated to the sub-field. It becomes possible in this way to express various kinds of intermediate luminance of $2^N$ stages (N: number of sub-fields; hereinafter called "gradation") through combinations of the sub-fields that are to emit light during one-field period.

To accomplish gradation driving on the basis of the sub-field method described above, a driving apparatus (not shown in the drawings) applies various driving pulses to the PDP and causes various discharges in the discharge cells. In other words, the driving apparatus first applies a reset pulse to the row electrode pairs of the PDP and induces reset discharge in all the discharge cells. A predetermined quantity of wall charge is uniformly formed in all the discharge cells due to this reset discharge. Next, the driving apparatus causes serially and selectively erase discharge of the discharge cells in accordance with the input image signals for one horizontal scan line (hereinafter called "one display line"). In this instance, the wall charge remaining inside the discharge cells disappears in those discharge cells in which the selective erase discharge is induced. In those discharge cells in which the selective erase discharge is not induced, on the other hand, the wall charge created by the reset discharge remains as such. Next, the driving apparatus alternately and simultaneously applies sustain pulses the number of times corresponding to each sub-field to all the row electrode pairs. Only those discharge cells in which the wall charge remains repeatedly cause the sustain discharge for the period corresponding to the sub-field in accordance with the application of such sustain pulse and keep the light emission state resulting from this sustain discharge.

In the PDP, however, the quantity of the wall charge created by various kind of discharges does not-remain constant due to the temperature change of the panel, the shift of display luminance, the change with time, and so forth. For this reason, the PDP involves the problem that variance occurs in the intensity of discharge and display quality gets deteriorated.

To solve the problems described above, the invention aims at providing an apparatus for driving a display panel that can always execute quality image display.

SUMMARY OF THE INVENTION

The invention provides an apparatus for driving a display panel for each of a plurality of sub-fields constituting each field of an input image signal, the display panel including a plurality of row electrodes corresponding to display lines, a plurality of column electrodes so arranged as to intersect the row electrodes, respectively, and capacitive discharge cells each formed at a point of intersection between the row electrode and the column electrode and operating as a pixel, comprising address means for applying a scan pulse to the row electrode in each of the sub-fields and a pixel data pulse corresponding to the input image signal to the column electrode, thereby allowing each of the discharge cells to selectively discharge so as to set the discharge cell to either a light-on mode or a light-off mode; and light emission sustain means for repeatedly applying a sustain pulse to the row electrode in each of the sub-fields thereby allowing only the discharge cell in the light-on mode to repeatedly sustain discharge; wherein a fall period in which a voltage value of the last sustain pulse of the sustain pulses applied to the row electrode in the sub-field is decreasing includes a first voltage drop period in which the voltage value gently lowers, a voltage constant period which follows the first voltage drop period and in which the voltage value remains constant for a predetermined period, and a second voltage drop period which follows the voltage constant period and in which the voltage lowers more gently than in the first voltage drop period.

BRIEF DESCRIPTION OF THE DRAWINGS

FIG. 2 shows an example of a data conversion table of a pixel driving data generation circuit 30 and a light emission driving pattern inside one field display period;

DETAILED DESCRIPTION OF THE INVENTION

Preferred embodiments of the invention will be hereinafter explained in detail with reference to the accompanying drawings.

Figure 1:
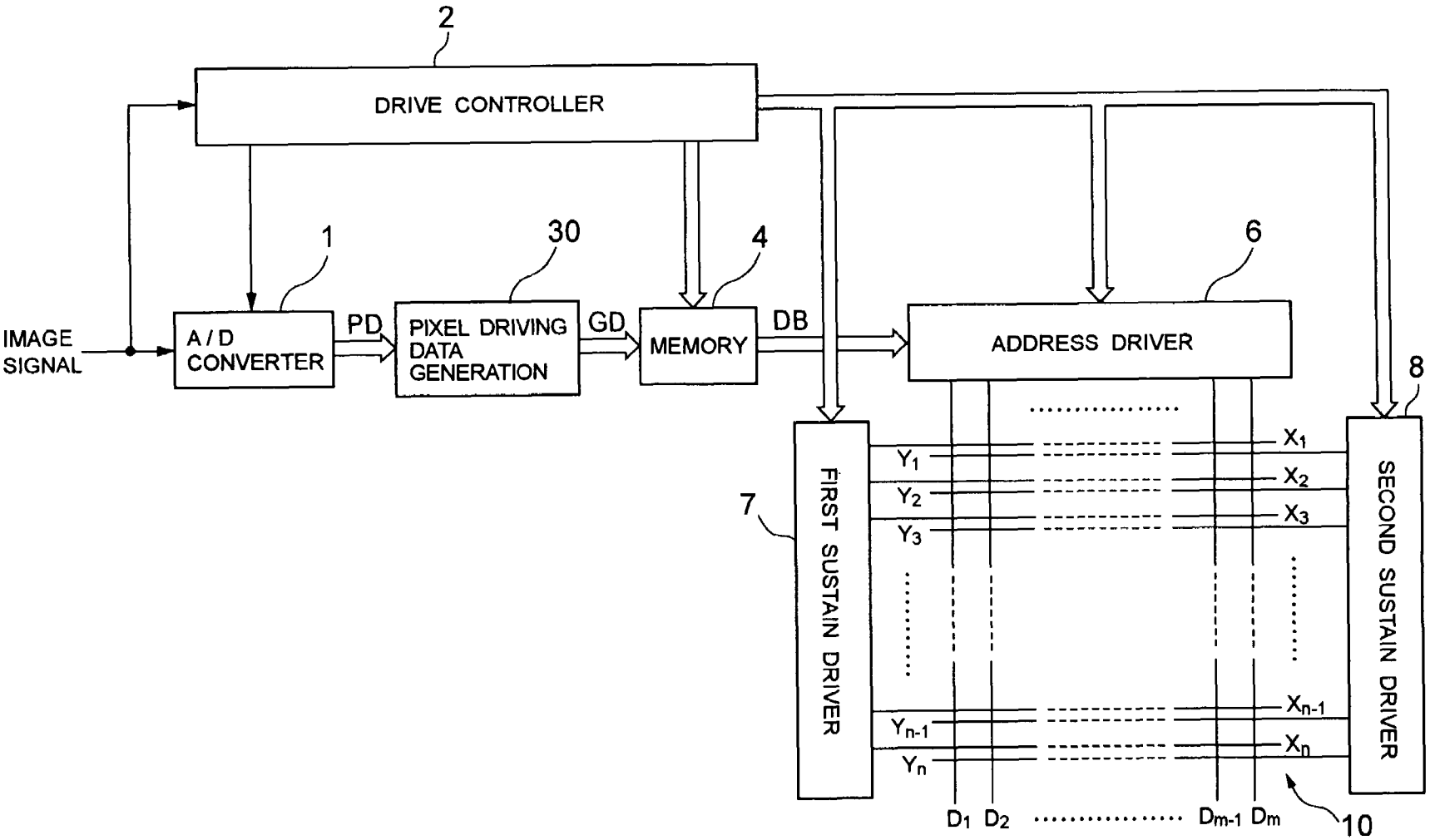
FIG. 1 shows a schematic construction of a plasma display device according to the invention.

FIG. 1 shows a schematic construction of a plasma display device having a plasma display panel as a display panel mounted thereto.

Referring to FIG. 1, a PDP 10 as the plasma display panel has m column electrodes $D_1$ to $D_m$, and n row electrodes $X_1$ to $X_n$ and n row electrodes $Y_1$ to $Y_n$ that are respectively so arranged as to intersect the column electrodes. Each pair of row electrode $X_i$ ($1 \leqq i \leqq n$) and row electrode $Y_i$ ($1 \leqq i \leqq n$) of the row electrodes $X_1$ to $X_n$ and the row electrodes $Y_1$ to $Y_n$ operates as a first display line to nth display line in the PDP 10. A discharge space into which a discharge gas is sealed is defined among each column electrode D, each row electrode X and each row electrode Y. A capacitive discharge cell is formed at each point of intersection between each row electrode pair containing this discharge space and each column electrode.

An A/D converter 1 samples an analog input image signal in response to a clock signal supplied from a driving control circuit 2 and converts the analog input image signal to pixel data PD of four bits, for example, corresponding to each pixel. A pixel driving data generation circuit 30 converts the 4-bit pixel data PD to 14-bit pixel driving data GD in accordance with a data conversion table shown in FIG. 2 and supplies the data GD to a memory 4. The memory 4 serially stores the 14-bit pixel driving data GD. Whenever write of pixel driving data $GD_{1,1}$ to $GD_{n,m}$ for one image frame (n rows by m columns) is complete, the memory 4 separates each pixel driving data $GD_{1,1}$ to $GD_{n,m}$ into each bit digit ($1^{st}$ to $14^{th}$ bits) and reads out the pixel driving data for each display line in such a fashion as to correspond to each sub-field SF1 to SF14 that will be later described. The memory 4 supplies the read pixel driving data bits (m bits) for one display line as pixel driving data bits DB1 to DB(m) to an address driver 6.

The driving control circuit 2 generates a clock signal for the A/D converter 1 and a write/read signal for the memory 4 in synchronism with horizontal and vertical sync signals in the input image signals described above. The driving control circuit 2 further generates various timing signals for controlling driving of an address driver 6, a first sustain driver 7 and a second sustain driver 8 in synchronism with the horizontal and vertical sync signals.

The address driver 6 applies each of m pixel data pulses having a voltage corresponding to a logic level of a pixel driving data bit DB for 1 display line, that is read out from the memory 4, to each of the column electrodes $D_1$ to $D_m$. The first sustain driver 7 and second sustain driver 8 generate various kinds of driving pulses for inducing various kinds of discharges for each of the discharge cells of the PDP 10 and applies them to the row electrodes $X_1$ to $X_n$ and $Y_1$ to $Y_n$ of the PDP 10. To cause gradation driving of the PDP 10 in accordance with a light emission driving format shown in FIG. 3, the driving control circuit 2 supplies various kinds of switching signals SW (to be later described) to the address driver 6 and the first and second sustain drivers 7 and 8.

Figure 3:
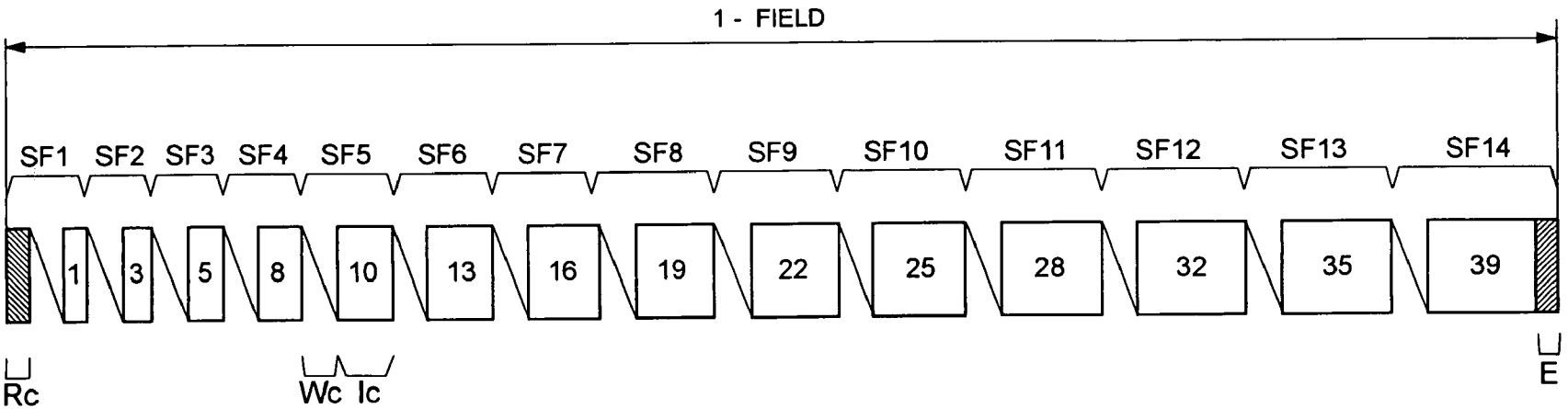
FIG. 3 shows an example of a light emission driving pattern.

Incidentally, in the light emission driving format shown in FIG. 3, the display period of one field is divided into 14 sub-fields SF1 to SF14 and the PDP 10 is driven in each sub-field. In this instance, the address step Wc and the light emission sustain step Ic are executed in each sub-field and a simultaneous reset step Rc is executed only in the first sub-field SF1. An erase step E is executed in only the last sub-field SF14. Incidentally, the term "field" is used by considering the case of image signals of an interlace system such as the NTSC system and corresponds to a frame in the case of image signals of a non-interlace system.

Figure 4:
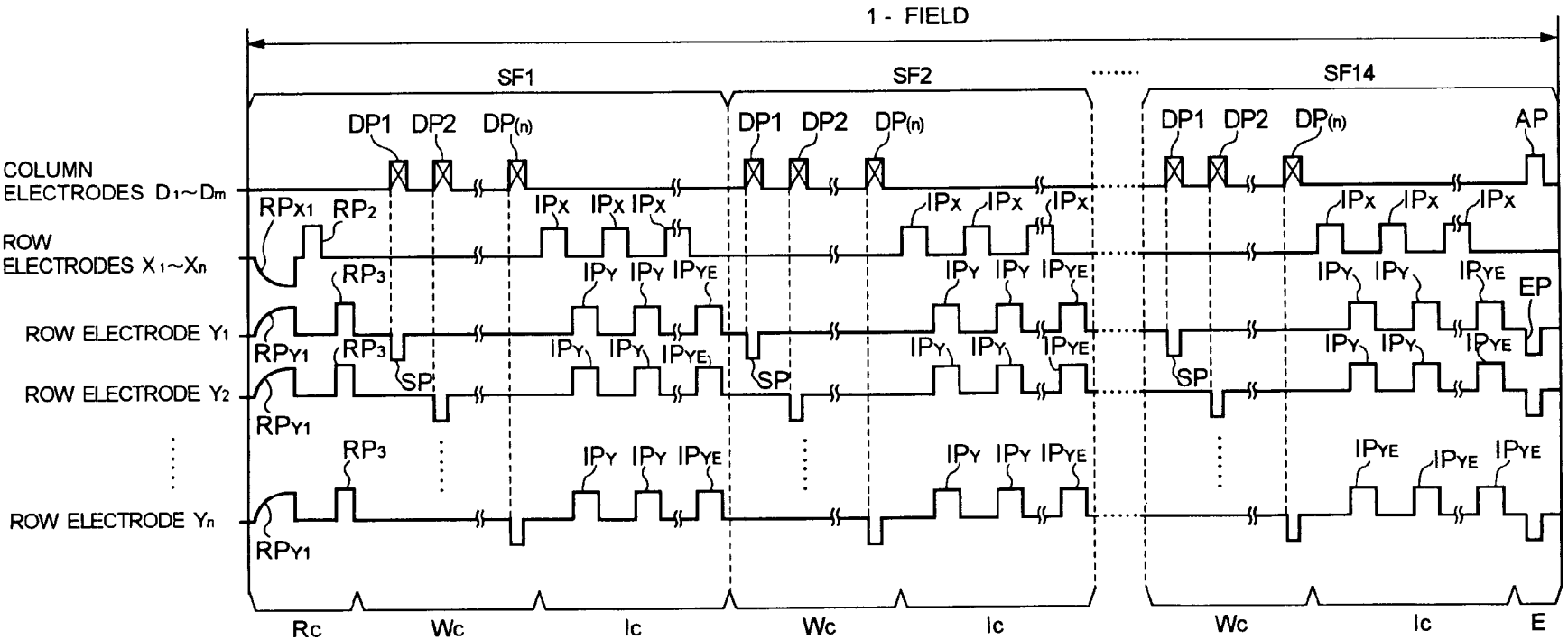
FIG. 4 shows various driving pulses applied to a PDP 10 and an example of their application timing.

FIG. 4 shows various kinds of driving pulses applied by the address driver 6 and the first and second sustain drivers 7 and 8 to the PDP 10 in the simultaneous reset step Rc, the address step Wc, the light emission sustain step Ic and the erase step E described above, and their application timings.

First, in the simultaneous reset step Rc executed in the beginning sub-field SF1, each of the first and second sustain drivers 7 and 8 simultaneously applies the first reset pulses $RP_{x1}$ and $RP_{y1}$ having waveforms shown in FIG. 4 to each of the row electrodes $X_1$ to $X_n$ and $Y_1$ to $Y_n$ of the PDP 10. Consequently, all the discharge cells in the PDP 10 are reset and discharged and wall charge of a predetermined quantity is uniformly formed inside each discharge cell. Immediately after the application of the first reset pulses $P_{x1}$ and $P_{y1}$, the first sustain driver 7 simultaneously applies the second reset pulse $RP_2$ shown in FIG. 4 to each of the row electrodes $X_1$ to $X_n$. Furthermore, immediately after the application of the second reset pulse $RP_2$, the second sustain driver 8 simultaneously applies the third reset pulse $RP_3$ shown in FIG. 4 to each of the row electrodes $Y_1$ to $Y_n$. In this instance, whenever the second reset pulse $RP_2$ and the third reset pulse $RP_3$ are applied, reset discharge is induced in each discharge cell and a priming particle of a desired quantity is formed in the discharge space. As a result of such a simultaneous reset step Rc, the wall charge is uniformly formed inside all the discharge cells and all the discharge cells are initialized to a light-on mode.

Next, in the address step Wc, the address driver 6 generates m pixel data pulses corresponding to the logic levels of the pixel driving data bits DB1 to DB(m) for one display line that are supplied from the memory 4, and applies a pixel data pulse group DP of these m pixel data pulses to the column electrodes $D_1$ to $D_m$.

For example, in the address step Wc of the sub-field SF1, the address driver 6 first applies the pixel data pulse group DP1 of the m pixel data pulses based on the pixel driving data bits DB1 to DB(m) corresponding to the first display line to the column electrodes $D_1$ to $D_m$. Next, the address driver 6 applies the pixel data pulse group DP2 of the m pixel data pulses based on the pixel driving data bits DB1 to DB(m) corresponding to the second display line to the column electrodes $D_1$ to $D_m$. The address driver 6 thereafter applies serially the pixel data pulse groups DP3 to DP(n) corresponding to the third to nth display lines to the column electrodes $D_1$ to $D_m$ as shown in FIG. 4. Incidentally, the address driver 6 generates a low voltage (0 V) pixel data pulse when the pixel driving data bit DB has the logic level 0 and a high voltage pixel data pulse when the pixel driving data bit DB has the logic level 1.

In the address step Wc, further, the second sustain driver 8 generates the scan pulses SP shown in FIG. 4 in synchronism with the application timing of each pixel data pulse group and serially applies the scan pulses SP to the row electrodes $Y_1$ to $Y_n$. In this instance, discharge (selective erase discharge) selectively occurs in only the discharge cells at the points of intersection of the row electrodes to which the scan pulse SP is applied and the column electrodes to which the high voltage pixel data pulse is applied and the wall charge remaining inside the discharge cells is erased. Here, the discharge cells in which the selective erase discharge is induced and which loses the wall charge shift to the light-off mode. On the other hand, the wall discharge remains as such in the discharge cells in which the selective erase discharge is not induced. Therefore, these discharge cells keep the light-on mode.

In other words, as the address step Wc is executed, so-called "write" of the pixel data in which each discharge cell is set to either the light-on mode or the light-off mode depending on the pixel data is executed.

Next, in the light emission sustain step Ic of each sub-field SF1 to SF14, the first sustain driver 7 and the second sustain driver 8 apply alternately and repeatedly the sustain pulses $IP_x$ and $IP_y$ to the row electrodes $X_1$ to $X_n$ and $Y_1$ to $Y_n$ as shown in FIG. 4. Incidentally, the number of times of the application of the sustain pulses IP in such a light emission sustain step Ic is different in each sub-field as shown in FIG. 3.

In other words, when the number of times of the application pulses IP in the light emission sustain step Ic of the sub-field SF1 is "1", the number of times of the application of the sustain pulses in the light emission sustain step Ic of each sub-field is set so as to attain ratios of number-of-times listed below:

SF1: 1
SF2: 3
SF3: 5
SF4: 8
SF5: 10
SF6: 13
SF7: 16
SF8: 19
SF9: 22
SF10: 25
SF11: 28
SF12: 32
SF13: 35
SF14: 39

In this case, only the discharge cells in which the wall charge remains as such, that is, only the discharge cells set to the light-on mode in the address step Wc described above, perform sustain discharge every time the sustain pulses IPx and IPy described above are applied, and keep the light emission state resulting from the sustain discharge the number of times of discharge allocated to each sub-field. Incidentally, the sustain discharge that is last induced in each light emission sustain step Ic has also the role of adjusting the quantity of the wall charge remaining inside each discharge cell to a suitable quantity so as to suitably induce selective erase discharge in the address step Wc in the next sub-field.

Here, the pixel driving data GD generated on the basis of the input image signal decides whether each discharge cell is set to the light-on mode or the light-off mode in the address step Wc. In this instance, the pattern that can be assumed as the 14-bit pixel driving data GD is 15 patterns shown in FIG. 2. In the pixel driving data GD for the 15 patterns shown in FIG. 2, the bit that can become the logic 1 inside the first to $14^{th}$ bits is always 1 or below. Therefore, when driving is made by using such pixel driving data GD, selective erase discharge is induced in only the address step Wc of one sub-field among the sub-fields SF1 to SF14. In other words, the wall charge formed in all the discharge cells of the PDP 10 in the simultaneous reset step Rc remains as such until selective erase discharge described above is induced. That is, each discharge cell keeps the light-on mode until the selective erase discharge is made in the one-field period and continuously performs sustain discharge light emission in each light emission sustain step Ic (represented by white circle) in each of the sub-fields existing in the period.

In the erase step E that is executed in only the end sub-field SF14, the address driver 6 generates an erase pulse AP and applies it to each of the column electrodes $D_1$ to $D_m$. The second sustain driver 8 generates an erase pulse EP in synchronism with the application timing of such the erase pulse AP and applies it to each of the row electrodes $Y_1$ to $Y_n$. As these erase pulses AP and EP are simultaneously applied, erase discharge is induced inside all the discharge cells of the PDP 10 and the wall charge remaining in all the discharge cells disappears.

Therefore, when driving is conducted in accordance with the light emission driving format shown in FIG. 3 by using the pixel driving data GD having the 15 patterns shown in FIG. 2, intermediate luminance for 15 gradations listed below becomes possible and a display image corresponding to the input image signals is displayed on the screen of the PDP 10:

{0, 1, 4, 9, 17, 27, 40, 56, 75, 97, 122, 150, 182, 217, 255}

Figure 5:
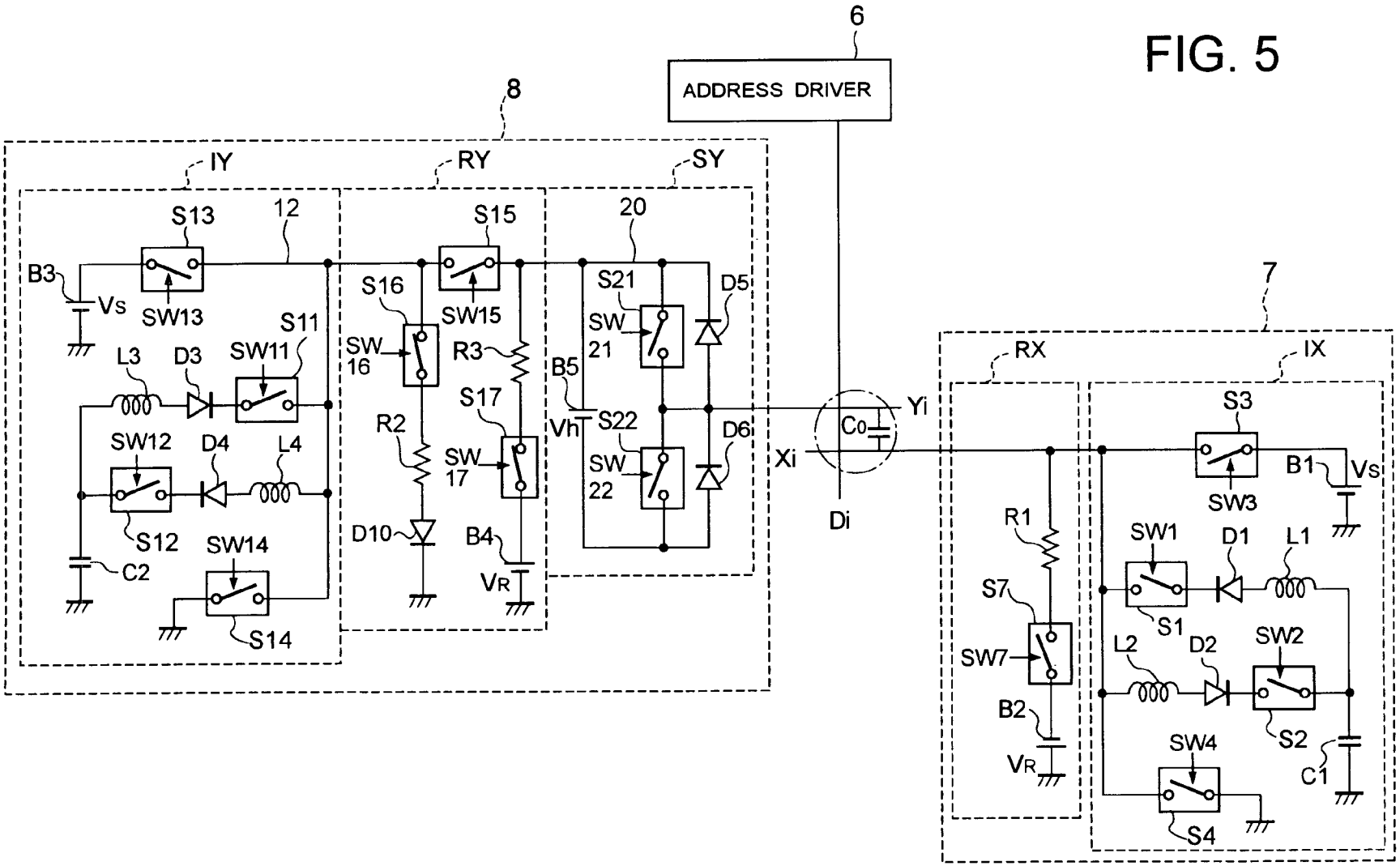
FIG. 5 shows an example of an internal construction of each of a first sustain driver 7 and a second sustain driver 8 shown in FIG. 1.

FIG. 5 shows the internal constructions of the first and second sustain drivers 7 and 8 for generating the reset pulse RP, the scan pulse SP, the sustain pulse IP and the erase pulse EP.

As shown in FIG. 5, the first sustain driver 7 includes a reset pulse generation circuit RX for generating the reset pulse $RP_x$ and a sustain pulse generation circuit IX for generating the sustain pulse $IP_x$.

The reset pulse generation circuit RX includes a DC power source B2 for generating a DC voltage $V_R$, a switching device S7 and a resistor R1. A positive terminal of the DC power source B2 is set to an earth potential and its negative terminal is connected to the switching device S7. The switching device S7 remains ON while the switching signal SW7 supplied from the driving control circuit 2 is at the logic level 1 and applies a voltage ($-V_R$) of the negative terminal of the DC power source B2 to the row electrode X through the resistor R1.

The sustain pulse generation circuit IX includes a DC power source B1 for generating a DC voltage $V_S$, switching devices S1 to S4, coils L1 and L2, diodes D1 and D2 and a capacitor C1. The switching device S1 remains ON while the switching signal SW1 supplied from the driving control circuit 2 is at the logic level 1 and applies a voltage at one of the electrode terminals of the capacitor C1 to the row electrode X through the coil L1 and the diode D1. The switching device S2 remains ON while the switching signal SW2 supplied from the driving control circuit 2 is at the logic level 1 and applies a voltage of the row electrode X to one of the electrode terminals of the capacitor C1 to the row electrode X through the coil L2 and the diode D2. The switching device S3 remains ON while the switching signal SW3 supplied from the driving control circuit 2 is at the logic level 1 and applies the voltage $V_S$ generated by the DC power source B1 to the row electrode X. The switching device S4 remains ON while the switching signal SW4 supplied from the driving control circuit 2 is at the logic level 1 and sets the row electrode X to the earth potential.

On the other hand, the second sustain driver 8 includes a reset pulse generation circuit RY for generating the reset pulse $RP_Y$ shown in FIG. 5, a scan pulse generation circuit SY for generating the scan pulse SP described above and a sustain pulse generation circuit IY for generating the sustain pulses $IP_Y$ and $IP_{YE}$ described above.

The reset pulse generation circuit RY includes a DC power source B4 for generating a DC voltage $V_R$, switching devices S15 to S17, a diode D10 and resistor R2 and R3. A negative terminal of the DC power source B4 is grounded and its positive terminal is connected to the switching device S17. The switching device S17 remains ON only while the switching signal SW17 supplied from the driving control circuit 2 is at the logic level 1 and applies the voltage $V_R$ of the positive terminal of the DC power source B4 to the line 20 through the resistor R3. A cathode electrode of the diode D10 is set to the earth potential. An anode electrode of the diode D10 is connected to one of the electrode terminals of the resistor R2 and the switching device S16 is connected to the other electrode terminal of the resistor R2. The switching device S16 remains ON only while the switching signal SW16 supplied from the driving control circuit 2 is at the logic level 1 and connects the other electrode terminal of the resistor R2 to the line 12.

The sustain pulse generation circuit IY includes a DC power source B3 for generating a DC voltage $V_S$, switching devices S11 to S14, coils L3 and L4, diodes D3 and D4 and a capacitor C2. The switching device S11 remains ON only while the switching signal SW11 supplied from the driving control circuit 2 is at the logic level 1 and applies the voltage of one of the electrode terminals of the capacitor C2 to the line 12 through the coil L3 and the diode D3. The switching device S12 remains ON only while the switching signal SW12 supplied from the driving control circuit 2 is at the logic level 1 and applies the voltage of the line 12 to one of the electrode terminals of the capacitor C2 through the coil L4 and the diode D4. The switching device S13 remains ON only while the switching signal SW13 supplied from the driving control circuit 2 is at the logic level 1 and applies the voltage $V_S$ generated by the DC power source B3 to the line 12. The switching device S14 remains ON only while the switching signal SW14 supplied from the driving control circuit 2 is at the logic level 1 and sets the line 12 to the earth potential.

The scan pulse generation circuit SY is disposed for each of the row electrodes $Y_1$ to $Y_n$. Each scan pulse generation circuit SY includes a DC power source B5 for generating a DC voltage $V_h$, switching devices S21 and S22 and diodes D5 and D6. The switching device S21 remains ON only while the switching signal SW21 supplied from the driving control circuit 2 is at the logic level 1 and connects the positive terminal of the DC power source B5 and the anode electrode of the diode D5 to the row electrode Y. The switching device S22 remains ON only while the switching signal SW22 supplied from the driving control circuit 2 is at the logic level 1 and connects the negative terminal of the DC power source B5 and the cathode electrode of the diode D6 to the row electrode Y. In the address step Wc shown in FIG. 4, the driving control circuit 2 serially applies the switching signal SW21 of the logic level 0 and the switching signal SW22 of the logic level 1to each of the scan pulse generation circuits SY disposed for the row electrodes $Y_1$ to $Y_n$, respectively. In consequence, the scan pulses SP of the negative polarity shown in FIG. 4 based on the voltage ($-V_h$) on the negative terminal of the DC power source B5 are serially applied to the row electrodes $Y_1$ to $Y_n$.

Next, the generation operation of the first reset pulses $RP_{x1}$ and $RP_{y1}$, the second reset pulse $RP_2$ and the third reset pulse $RP_3$ in the construction shown in FIG. 5 will be explained with reference to FIG. 6.

Figure 6:
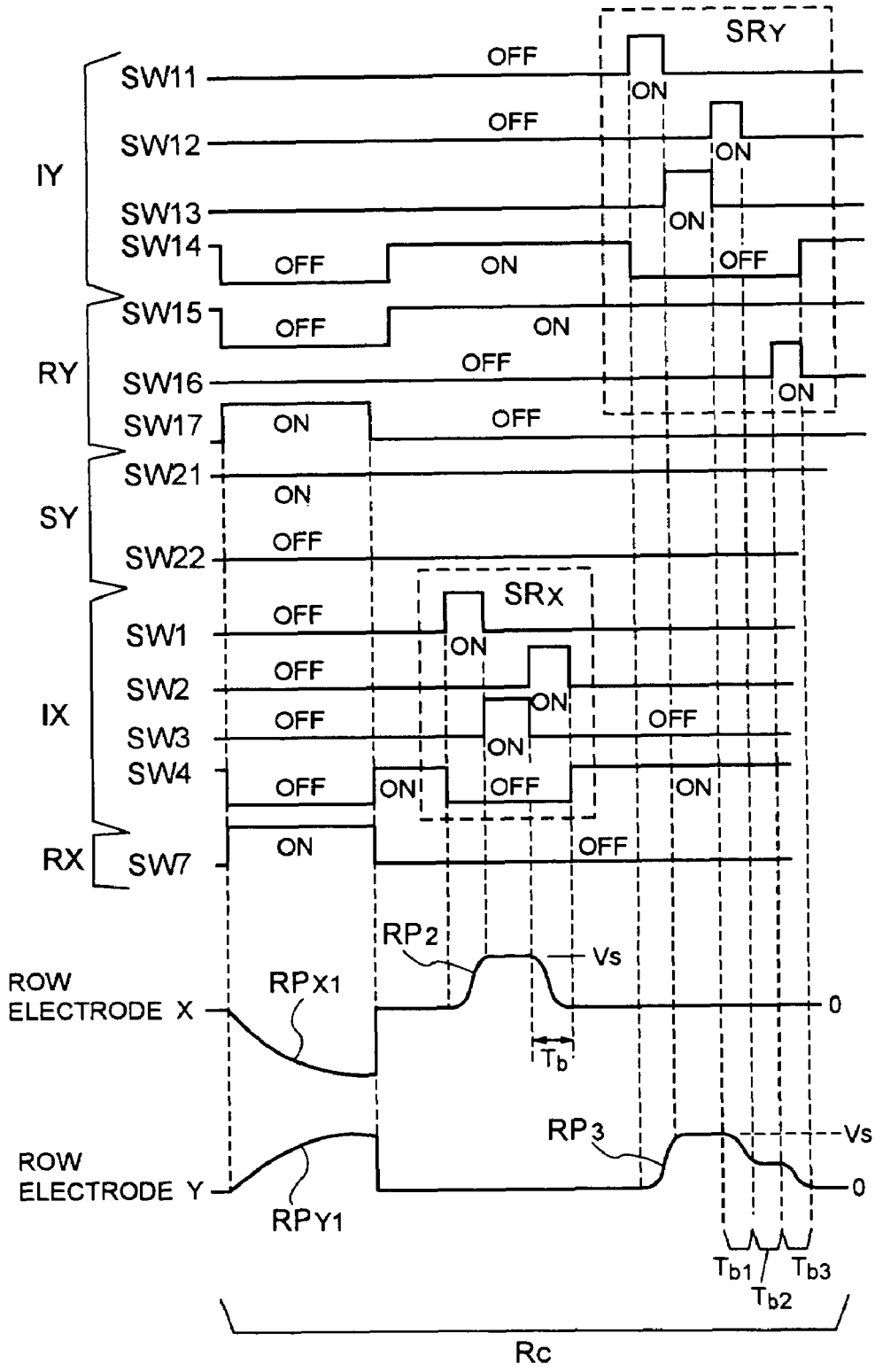
FIG. 6 shows various reset pulses applied to the PDP 10 and an example of a switching sequence when the reset pulses are generated.

In FIG. 6, the driving control circuit 2 first supplies the switching signal SW7 of the logic level 1 to the switching device S7. In this instance, the switching device S7 is turned ON and the voltage ($-V_R$) of the negative terminal of the DC power source B2 is applied to the row electrode X through the resistor R1. In consequence, the load capacitance $C_o$ of the PDP 10 is charged and the voltage of the row electrode X gradually lowers from the state of 0 volt as shown in FIG. 6. After the passage of a predetermined time, the driving control circuit 2 supplies the switching signal SW4 of the logic level 1 to the switching device S4. The switching signal S4 is turned ON in response to the switching signal SW4 of the logic level 1 and sets the row electrode X to the earth potential. Consequently, the voltage on the row electrode quickly shifts to 0 V as shown in FIG. 6.

As a result of a series of operations described above, a first reset pulse $RP_{x1}$ of the negative polarity having a gentle fall waveform but a sharp rise waveform is generated as shown in FIG. 6.

In the mean time, the driving control circuit 2 supplies the switching signal SW15 of the logic level 0 to the switching device S15. The driving control circuit 2 supplies the switching signal SW17 of the logic level 1 to the switching device S17. The driving control circuit 2 supplies the switching signal SW21 of the logic level 1 to the switching device S22. In this instance, both switching devices S17 and S21 are turned ON and the voltage $V_R$ of the positive terminal of the DC pour source B4 is applied to the row electrode Y through the switching device S17, the resistor R3, the line 20 and the switching device S21. Consequently, the load capacitance $C_o$ of the PDP 10 is charged and the voltage of the row electrode Y gradually rises from the 0 V as shown in FIG. 6. Because the switching device S4 is turned ON after the passage of a predetermined time as described above, the voltage of the row electrode Y sharply shifts to 0 V.

As a result of a series of operations described above, a first reset pulse $RP_{y1}$ of the positive polarity having a gentle rise waveform but a sharp fall waveform is generated as shown in FIG. 6.

Next, the driving control circuit 2 supplies the switching signals SW1 to SW4 whose state shifts in accordance with the switching sequence $SR_x$ shown in FIG. 6 to the switching devices S1 to S4 of the sustain pulse generation circuit IX. According to such a switching sequence $SR_x$, only the switching device S1 is first turned ON and the current resulting from the charge stored in the capacitor C1 flows into the discharge cells through the coil L1, the diode D1 and the row electrode X. In consequence, the voltage on the row electrode X gradually rises as shown in FIG. 6. Next, only the switching device S3 is turned ON and the voltage $V_S$ of the positive terminal of the DC power source B1 is immediately applied to the row electrode X. In consequence, the voltage on the row electrode X is the voltage $V_S$ shown in FIG. 6. Next, only the switching device S2 is turned ON and the current resulting from the load capacitance $C_o$ between the row electrodes X and Y flows into the capacitor C1 through the coil L2 and the diode D2 with the result that the voltage of the row electrode X gradually lowers as shown in FIG. 6.

According to the switching sequence $SR_x$, therefore, the second reset pulse $RP_2$ of the positive polarity having both gentle rise and fall waveforms is generated as shown in FIG. 6.

When the voltage on the row electrode X shifts from 0 V to the voltage $V_S$ in response to such a second reset pulse $RP_2$, reset discharge is induced and weak discharge is further induced in the period in which the voltage of the row electrode X shifts from the voltage $V_S$ to 0 V, that is, in the fall period of the second reset pulse $RP_2$.

Next, the driving control circuit 2 supplies the switching signals SW11 to SW14 the state of which changes in accordance with the switching sequence $SR_Y$ shown in FIG. 6 to the sustain pulse generation circuit IY and the switching signal SW16 the state of which changes in accordance with this switching sequence $SR_Y$ is supplied to the reset pulse generation circuit RY.

According to such a switching sequence $SR_Y$, only the switching device S11 is first turned ON and the current resulting from the charge stored in the capacitor C2 flows into the discharge cells through the coil L3, the diode D3 and the row electrode Y. In consequence, the voltage of the row electrode Y gradually rises as shown in FIG. 6. Next, only the switching device S13 is turned ON and the voltage $V_S$ of the positive terminal of the DC power source B3 is directly applied to the row electrode Y. The voltage of the row electrode Y becomes equal to the voltage $V_S$ shown in FIG. 6. Next, only the switching device S12 is turned ON and the current resulting from the charge stored in the load capacitance $C_o$ between the row electrodes X and Y flows into the capacitor C2 through the coil L4 and the diode D4. In this case, the voltage of the row electrode Y gradually lowers due to the charging operation of the capacitor C2 as shown in FIG. 6 (first voltage drop period $T_{b1}$). Next, all the switching devices S11 to S14 and S16 are turned OFF for a predetermined time. The line 12 therefore enters the high impedance state and in the mean time, the voltage of the row electrode Y remains constant as shown in FIG. 6 (voltage constant period $T_{b2}$). Next, only the switching device S16 is turned ON and the row electrode Y is set to the earth potential through the resistor R2 and the diode D10. Therefore, the voltage of the row electrode Y gradually lowers again and reaches 0 V (second voltage drop period $T_{b3}$). Incidentally, a change ratio of the voltage is smaller in the second voltage drop period $T_{b3}$ than in the first voltage drop period $T_{b1}$. In other words, the voltage drops more gently in the second voltage drop period $T_{b3}$ than in the first voltage drop period $T_{b1}$.

According to the switching sequence $SR_Y$, therefore, the third reset pulse $RP_3$ of the positive polarity having both gentle rise and fall waveforms is generated as shown in FIG. 6. In this instance, the change ratio in the voltage drop period in the third reset pulse $RP_3$ is smaller than the change ratio in the drop period in the second reset pulse $RP_2$ applied immediately before the former. In other words, the fall waveform of the third reset pulse $RP_3$ applied at the end of the simultaneous reset step Rc is more gentle than the fall waveform in the second reset pulse $RP_2$ applied immediately before the third reset pulse $RP_3$.

When such a third reset pulse $RP_3$ is applied to all the row electrodes Y, the third reset discharge is induced in all the discharge cells and the priming particles occur in the discharge spaces. Further, a weak discharge is induced in the fall period ($T_{b1}+T_{b2}+T_{b3}$) of the third reset pulse $RP_3$ and allows a part of the wall charge formed inside each discharge cell to disappear. Consequently, the quantity of the wall charge inside the discharge cells can be adjusted to a desired quantity of such a level that can appropriately induce selective discharge in the address step Wc.

However, the quantity of the wall charge formed inside each discharge cell fluctuates depending on the panel temperature, the size of the light emission load, the change with time, and so forth, and it is difficult to keep the quantity of the wall charge inside each discharge cell at a desired quantity.

Therefore, the fall period of the third reset pulse $RP_3$ is constituted by the first voltage drop period $T_{b1}$ in which the voltage gradually lowers, the voltage constant period $T_{b2}$ in which the drop of the voltage stops and the voltage value remains constant for a predetermined time and the second voltage drop period $T_{b3}$ in which the voltage drops more gently than in the first voltage drop period $T_{b1}$. In this case, the voltage in the fall period of the reset pulse $RP_3$ in the voltage constant period $T_{b2}$ is kept constant for a predetermined period so that the state of the wall charge can be stabilized. It becomes possible in this way to adjust the quantity of the wall charge inside each discharge cell to a desired quantity capable of appropriately inducing the selective discharge in the fall period of the reset pulse $RP_3$ and in the address step Wc in spite of the influences of the panel temperature, the size of the light emission load, the change with time, and so forth.

Because the selective discharge can be correctly induced in the address step in spite of the influences of the panel temperature, the size of the light emission load, the change with time, and so forth, high quality image display can be maintained.

Next, the generation operation of the sustain pulses $IP_X$ and $IP_Y$ and the sustain pulses $IP_{YE}$ applied last in each light emission sustain step Ic in the construction shown in FIG. 5 will be explained with reference to FIG. 7.

Figure 7:
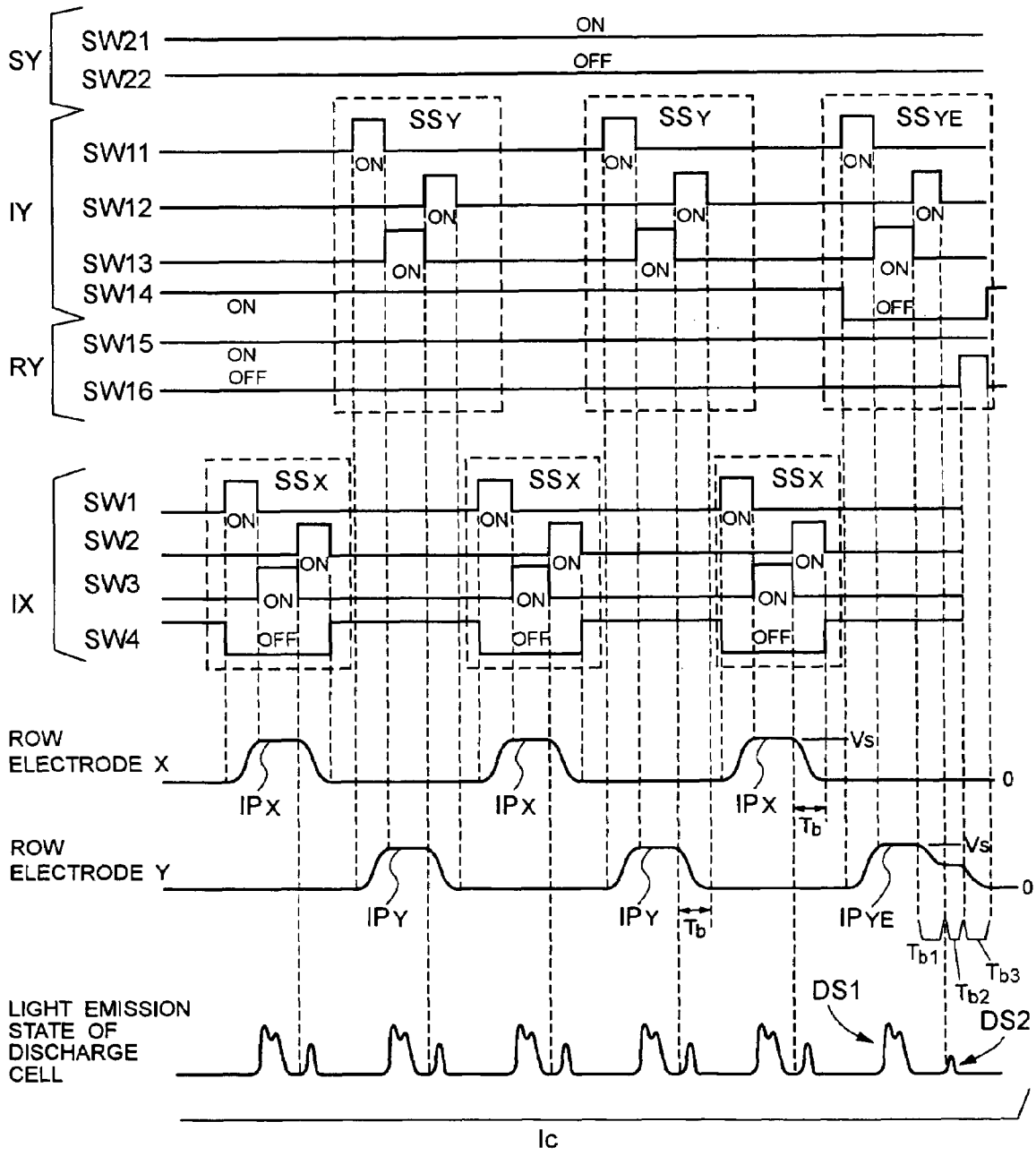
FIG. 7 shows various sustain pulses applied to the PDP 10 and an example of a switching sequence when the sustain pulses are generated.

In FIG. 7, the driving control circuit 2 supplies those switching signals SW1 to SW4 whose state shifts in accordance with the switching sequence $SS_x$ shown in FIG. 7 to the switching devices S1 to S4 of the sustain pulse generation circuit IX. According to such a switching sequence SSx, the switching device S4 is turned OFF. In the mean time, only the switching S1 is first turned ON and the current resulting from the charge stored in the capacitor C1 flows into the discharge cell through the coil L1, the diode D1 and the row electrode X. Consequently, the voltage of the row electrode X gradually rises as shown in FIG. 7. Next, only the switching device S3 is turned ON and the voltage $V_S$ of the positive terminal of the DC power source B1 is applied to the row electrode X through the switching device S3. In consequence, the voltage of the row electrode X is fixed to the voltage $V_S$ as shown in FIG. 7. Next, only the switching device S2 is turned ON and the current resulting from the charge stored in the load capacitance Co between the row electrodes X and Y flows into the capacitor C1 through the coil L2, the diode D2 and the switching device S2. Consequently, the voltage of the row electrode X gradually lowers as shown in FIG. 7. As the switching device S4 is turned ON, the voltage of the row electrode X becomes 0 V.

According to the switching sequence $SS_x$, the sustain pulse $IP_x$, of the positive polarity having both gentle rise and fall waveforms is generated as shown in FIG. 7.

The driving control circuit 2 executes periodically and repeatedly the control in accordance with the switching sequence $SS_x$ the number of times corresponding to the number of times of light emission allocated to each subfield. Accordingly, as shown in FIG. 7, the sustain pulse generation circuit IX repeatedly generates the sustain pulses having the waveform shown in FIG. 7. In this instance, whenever the sustain pulse $IP_x$ is applied, sustain discharge (expressed by DS1 in FIG. 7) is induced in the discharge cell that is in the light-on mode. Incidentally a weak discharge (expressed by DS2 in FIG. 7) is induced at the drop of the voltage of the sustain pulse $IP_x$.

The driving control circuit 2 supplies the switching signals SW11 to SW13 whose state shifts in accordance with the switching sequence $SS_Y$ shown in FIG. 7 to the sustain pulse generation circuit IY. Incidentally, both switching devices S15 and S21 are set to the ON state in the mean time.

In the switching sequence SSY, only the switching device S11 is turned ON and the current resulting from the charge stored in the capacitor C2 flows into the discharge cell through the coil L3, the diode D3, the switching devices S11, S15 and S21 and the row electrode Y. In consequence, the voltage of the row electrode Y gradually rises as shown in FIG. 7. Next, only the switching device S13 is turned ON and the voltage $V_S$ of the positive terminal of the DC power source B3 is applied to the row electrode Y through the switching devices S13, S15 and S21. The voltage of the row electrode Y becomes equal to the voltage $V_S$ as shown in FIG. 7. Next, only the switching device S12 is turned ON, the current resulting from the charge stored in the load capacitance Co between the row electrodes X and Y flows into the capacitor C2 through the row electrode Y, the switching devices S21 and S15, the coil L4, the diode D4 and the switching device S12. In this instance, the voltage of the row electrode Y gradually lowers as shown in FIG. 7 due to the charging operation of the capacitor C2. Therefore, according to the switching sequence $SS_Y$, the sustain pulse $IP_Y$ of the positive polarity having both gentle rise and fall waveforms is generated as shown in FIG. 7.

The driving control circuit 2 executes periodically and repeatedly the control in accordance with the switching sequence $SS_Y$ described above as shown in FIG. 7. In consequence, the sustain pulse generation circuit IY repeatedly generates the sustain pulses $IP_Y$ having the waveform shown in FIG. 7. In this instance, whenever the sustain pulse $IP_Y$ is applied, the sustain discharge is induced inside the discharge cells that are in the light-on mode. Incidentally, a weak discharge is induced at the drop of the voltage of the sustain pulse $IP_Y$, too.

However, when the last sustain pulse $IP_{YE}$ in each light emission sustain step Ic is generated, the driving control circuit 2 supplies the switching signals SW11 to SW14 whose state shifts in accordance with the switching sequence $SS_{YE}$ shown in FIG. 7 to the sustain pulse generation circuit IY and supplies the switching signal SW16 to the reset pulse generation circuit RY.

In the switching sequence $SS_{YE}$, the switching device S14 is set to the OFF state. In the mean time, only the switching device S11 is first turned ON and the current resulting from the charge stored in the capacitor C2 flows into the discharge cell through the coil L3, the diode D3, the switching devices S11, S15 and S21 and the row electrode Y. Consequently, the voltage of the row electrode Y gradually rises as shown in FIG. 7. Next, only the switching device S13 is turned ON and the voltage $V_S$ of the positive terminal of the DC power source B3 is applied to the row electrode Y through the switching devices S13, S15 and S21. Consequently, the voltage of the row electrode Y becomes equal to the voltage $V_S$ as shown in FIG. 7. Next, only the switching device S12 is turned ON and the current resulting from the charge stored in the load capacitance $C_o$ between the row electrodes X and Y flows into the capacitor C2 through the row electrode Y, the switching devices S21 and S15, the coil L4, the diode D4 and the switching device S12. In this instance, the voltage of the row electrode Y gradually lowers due to the charging operation of the capacitor C2 as shown in FIG. 7 (first voltage drop period $T_{b1}$). Next, the switching devices S11 to S14 and S16 are set to the OFF state for a predetermined period. Consequently, the line 12 enters the high impedance state and in the mean time, the voltage of the row electrode Y remains constant as shown in FIG. 7 (voltage constant period $T_{b2}$). Next, only the switching device S16 is turned ON. Consequently, the row electrode Y is set to the earth potential through the switching devices S21, S15 and S16, the resistor R2 and the diode 10, so that the voltage of the row electrode Y again lowers gradually and reaches 0 V (second voltage drop period $T_{b3}$). Incidentally, the change ratio of the voltage value is smaller in the second voltage drop period $T_{b3}$ than in the first voltage drop period $T_{b1}$. In other words, the voltage drops more gently in the second voltage drop period $T_{b3}$ than in the first voltage drop period $T_{b1}$.

According to the switching sequence $SS_{YE}$, therefore, the sustain pulse $IP_{YE}$ of the positive polarity having both gentle rise and fall waveforms is generated as shown in FIG. 7. In this instance, the change ratio in the voltage fall period in the sustain pulse $IP_{YE}$ is smaller than the change ratio in the fall period of the sustain pulse IP applied immediately before the sustain pulse $IP_{YE}$. In other words, the fall waveform of the voltage value of the sustain pulse $IP_{YE}$ applied last in the light emission sustain step Ic is more gentle than the fall waveform of the sustain pulse IP applied immediately before the sustain pulse $IP_{YE}$.

Here, the last sustain discharge (represented by DS1 in FIG. 7) is induced in each light emission sustain step Ic in accordance with the sustain pulse $IP_{YE}$ and a weak discharge is further induced in the fall period of this sustain pulse $IP_{YE}$ (represented by DS2 in FIG. 7). This weak discharge causes a part of the wall charge formed inside the discharge cell to disappear and the quantity of the wall charge inside the discharge cell is adjusted to a desired quantity capable of appropriately inducing the first reset discharge in the simultaneous reset step Rc.

However, because the quantity of the wall charge formed in the discharge cell fluctuates depending on the panel temperature, the size of the light emission load, the change with time, and so forth, it becomes difficult to keep the quantity of the wall charge inside each discharge cell at the desired quantity.

Therefore, as shown in FIG. 7, the fall period of the last sustain pulse $IP_{YE}$ is constituted by the first voltage drop period $T_{b1}$ in which the voltage gradually lowers, the voltage constant period $T_{b2}$ in which the drop of the voltage stops and keeps a constant voltage value for a predetermined period and the second voltage drop period $T_{b3}$ in which the voltage drops more gently than in the first voltage drop period $T_{b1}$. In this case, the condition of the wall charge is stabilized by keeping the voltage value in the fall period of the sustain pulse $IP_{YE}$ in the voltage constant period $T_{b2}$ constant for a predetermined period. Consequently, the quantity of the wall charge in each discharge cell can be adjusted to a desired quantity capable of appropriately inducing the first reset discharge in the simultaneous reset step Rc in the fall period of the last sustain pulse $IP_{YE}$ irrespective of the panel temperature, the size of the light emission load, the change with time, and so forth.

Because the reset discharge can be generated irrespective of the influences of the panel temperature, the size of the light emission load, the change with time, and so forth, high quality image display can be maintained.

Incidentally, the embodiment given above employs the gradation driving method shown in FIGS. 2 to 4 for gradation driving on the basis of the sub-field method but the invention is in no way limited thereto.

The embodiment given above employs a so-called "selective erase address method" that forms in advance the wall change inside all the discharge cells (simultaneous reset step Rc) and selectively erases the wall change inside each discharge cell in accordance with the input image signal. However, the invention can be similarly applied to a so-called "selective write address method" as a sub-field method that extinguishes in advance the wall charge inside all the discharge cells and selectively forms the wall charge in accordance with the input image signal.

This application is based on a Japanese patent application No. 2003-199660 which is hereby incorporated by reference.

What is claimed is:

1. An apparatus for driving a display panel for each of a plurality of sub-fields constituting each field of an input image signal, said display panel including a plurality of row electrodes corresponding to display lines, a plurality of column electrodes so arranged as to intersect said row electrodes, respectively, and capacitive discharge cells each formed at a point of intersection between said row electrode and said column electrode and operating as a pixel, comprising:

reset means for repeatedly applying a predetermined number of times a reset pulse to all of said row electrodes at the start of at least one of said sub-fields thereby allowing all of said discharge cells to repeatedly reset discharge so as to initialize the condition of said discharge cells;

address means for applying a scan pulse to said row electrode in each of said sub-fields and a pixel data pulse corresponding to said input image signal to said column electrode, thereby allowing each of said discharge cells to selectively discharge so as to set said discharge cell to either a light-on mode or a light-off mode; and light emission sustain means for repeatedly applying a sustain pulse to said row electrode in each of said sub-fields thereby allowing only said discharge cell in said light-on mode to repeatedly sustain discharge;

wherein:

only the last sustain pulse of the sustain pulses applied to said row electrode in each sub-field has a fall period constituted by a first sustain voltage drop period in which the voltage value gently lowers, a sustain voltage constant period which follows said first sustain voltage drop period and in which the voltage value remains constant for a predetermined period, and a second sustain voltage drop period which follows said sustain voltage constant period and in which the voltage lowers more gently than in said first sustain voltage drop period; and a reset-pulse fall period in which a voltage value of the last reset pulses repeatedly applied to said row electrode in said sub-field is decreasing includes a first reset voltage drop period in which the voltage value gently lowers, a reset voltage constant period in which the voltage value remains constant for a predetermined period, and a second reset voltage drop period in which the voltage lowers more gently than in said first reset voltage drop period.

2. An apparatus according to claim 1, wherein said light emission sustain means sets said row electrode to a high impedance state during said predetermined period so as to keep the voltage value of said last sustain pulse constant during said voltage constant period.

3. An apparatus for driving a display panel for each of a plurality of sub-fields constituting each field of an input image signal, said display panel including a plurality of row electrodes corresponding to display lines, a plurality of column electrodes so arranged as to intersect said row electrodes, respectively, and capacitive discharge cells each formed at a point of intersection between said row electrode and said column electrode and operating as a pixel, comprising:

address means for applying a scan pulse to said row electrode in each of said sub-fields and a pixel data pulse corresponding to said input image signal to said column electrode, thereby allowing each of said discharge cells to selectively discharge so as to set said discharge cell to either a light-on mode or a light-off mode; and light emission sustain means for repeatedly applying a sustain pulse to said row electrode in each of said sub-fields thereby allowing only said discharge cell in said light-on mode to repeatedly sustain discharge, said sustain pulse having a rise period in which the voltage rises to a first voltage from a second voltage and a fall period in which the voltage drops to said second voltage from said first voltage, wherein:

only the last sustain pulse of the sustain pulses applied to said row electrode in the sub-field has said fall period, said fall period having a first voltage drop period in which the voltage drops to a third voltage from said first voltage, a voltage-constant period which follows said first voltage drop period and in which the voltage remains at said third voltage, and a second voltage drop period which follows said voltage-constant period and in which the voltage drops to said second voltage from said third voltage, and the voltage on said row electrode is held at said second voltage after said second voltage drop period.

4. An apparatus according to claim 3, wherein a discharge for erasing a part of the wall charge formed inside the discharge cell occurs in said fall period of said last sustain pulse.

5. An apparatus according to claim 4, wherein said third voltage is equal to or less than a half of the difference between said first voltage and said second voltage.

6. An apparatus according to claim 4, wherein the difference between said third voltage and said second voltage is equal to or less than the difference between said first voltage and said third voltage.

* * * * *